US009072140B2

(12) United States Patent
Takahashi et al.

(10) Patent No.: US 9,072,140 B2
(45) Date of Patent: Jun. 30, 2015

(54) LIGHTING SOURCE AND LIGHTING APPARATUS

(71) Applicant: Panasonic Corporation, Osaka (JP)

(72) Inventors: Akira Takahashi, Osaka (JP); Kazuhiko Itoh, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/176,205

(22) Filed: Feb. 10, 2014

(65) Prior Publication Data

US 2014/0232277 A1 Aug. 21, 2014

(30) Foreign Application Priority Data

Feb. 15, 2013 (JP) ..... 2013-028249

(51) Int. Cl.

| | |
|---|---|
| ***H05B 37/02*** | (2006.01) |
| ***H05B 33/08*** | (2006.01) |
| ***F21K 99/00*** | (2010.01) |
| ***F21V 23/00*** | (2015.01) |

(52) U.S. Cl.

CPC ..... *H05B 33/0815* (2013.01); *F21K 9/135* (2013.01); *F21V 23/005* (2013.01); *H05B 33/0824* (2013.01)

(58) Field of Classification Search

CPC ..... H05B 33/0815; H05B 37/029; H05B 33/0803; H05B 33/0827; H05B 33/0857; Y02B 20/343; Y02B 20/345; F21K 9/135; F21K 9/30

USPC ..... 315/185 R, 192–194, 291, 294, 309, 315/312; 362/231, 249.02, 372, 800

See application file for complete search history.

(56) References Cited

U.S. PATENT DOCUMENTS

| | | | | |
|---|---|---|---|---|
| 8,587,205 | B2 * | 11/2013 | Ter Weeme et al. | 315/185 R |
| 2014/0049172 | A1 * | 2/2014 | Bakk | 315/192 |
| 2014/0197750 | A1 * | 7/2014 | Cash | 315/192 |
| 2014/0361711 | A1 * | 12/2014 | Takahashi | 315/294 |
| 2015/0077000 | A1 * | 3/2015 | Takahashi et al. | 315/193 |
| 2015/0077001 | A1 * | 3/2015 | Takahashi et al. | 315/193 |
| 2015/0077002 | A1 * | 3/2015 | Takahashi et al. | 315/193 |

FOREIGN PATENT DOCUMENTS

| | | |
|---|---|---|
| JP | 2009-009782 | 1/2009 |

* cited by examiner

*Primary Examiner* — Haiss Philogene
(74) *Attorney, Agent, or Firm* — Renner, Otto, Boisselle & Sklar, LLP

(57) ABSTRACT

An LED module includes: a first LED array which includes a plurality of first LEDs connected in series and through which a first branch current flows; a second LED array which includes a plurality of second LEDs 121 connected in series and through which a second branch current flows; and a transistor which is connected to the second LED array in series, and adjusts a second branch current according to a differential voltage between a first total forward voltage and a second total forward voltage. The first total forward voltage is a sum of forward voltages and includes the same number of the forward voltages as the number of the first LEDs. The second total forward voltage is a sum of forward voltages and includes the same number of the forward voltages as the number of the second LEDs.

14 Claims, 15 Drawing Sheets

LIGHTING SOURCE AND LIGHTING APPARATUS

CROSS REFERENCE TO RELATED APPLICATION

The present application is based on and claims priority of Japanese Patent Application No. 2013-028249 filed on Feb. 15, 2013. The entire disclosure of the above-identified application, including the specification, drawings and claims is incorporated herein by reference in its entirety.

FIELD

The present invention relates to a light-emitting circuit and a light-emitting module each of which includes light-emitting elements such as light-emitting diodes (LEDs), and to a lighting apparatus including the light-emitting module.

BACKGROUND

Lighting apparatuses with light adjusting function have been widely used. For example, a lighting apparatus using an incandescent light bulb is capable of adjusting light by changing the level of current flowing through a filament serving as a light source. In adjusting the light from the incandescent light bulb from a darker state into a brighter state, for example, the emission color of the incandescent light bulb turns from orange into white. This is because the emission color of the incandescent light bulb changes depending on the temperature or the like of the filament, and the color temperature of emission of the incandescent light bulb decreases as the temperature of the filament decreases. The temperature of the filament changes depending on the level of current flowing through the filament.

On the other hand, there has been a recent growing popularity of replacement of the incandescent light bulb with a lighting apparatus using a light-emitting module including semiconductor light-emitting elements such as LEDs. In general, a change in level of current flowing through an LED chip does not change the emission color of the LED chip. This is because the emission color of the LED chip depends on the bandgap of a semiconductor material included in the LED chip, but does not depend on the current level. Hence, replacement of the incandescent light bulb with a lamp using LEDs as a light source (hereinafter, referred to as an LED lamp) in the conventional lighting apparatus having light adjusting function may cause a user to have a feeling of strangeness in regard to the emission color of the LED lamp during light adjustment.

In view of the above, Patent Literature (PTL) 1 discloses an LED module which is capable of changing the emission color in the use of the LEDs.

FIG. 11 is a circuit diagram of a conventional LED module disclosed in PTL 1. As shown in FIG. 11, the LED module 900 includes a red LED array 921 and a white LED array 922 which are connected in parallel. The red LED array 921 includes red LEDs 921*a*, 921*b*, 921*c*, . . . , 921*d*, 921*e*, and 921*f* which are connected in series. The white LED array 922 includes white LEDs 922*a*, 922*b*, . . . , 922*c*, and 922*d* which are connected in series. The white LED array 922 is connected in series to a bipolar transistor 924 and a resistive element 926. The bipolar transistor 924 has a base terminal connected to a variable voltage source 927 via a resistive element 925. Furthermore, the bipolar transistor 924 has a collector terminal connected to the cathode terminal of the white LED 922*d*, and an emitter terminal connected to the resistive element 926.

The LED module 900 is connected to a variable current source 933. Alternating-current (AC) power supplied from an AC source 931 undergoes AC to DC conversion performed by an AC/DC converter 932, and the resulting power is supplied to the variable current source 933. Accordingly, current is supplied to the LED module 900 from the variable current source 933.

The LED module 900 is capable of changing base current by changing base-emitter voltage of the bipolar transistor 924. Here, the collector current increases as the base current of the bipolar transistor 924 increases. This leads to an increase in current flowing through the white LED array 922. By increasing the current flowing through the white LED array 922 among the current supplied from the variable current source 933, the current flowing through the red LED array 921 relatively decreases. As a result, the emission color of the LED module 900 approaches white. On the other hand, by reducing the current flowing through the white LED array 922, the current flowing through the red LED array 921 relatively increases. As a result, the emission color of the LED module 900 approaches orange.

CITATION LIST

Patent Literature

[PTL 1] Japanese Unexamined Patent Application Publication No. 2009-009782

SUMMARY

Technical Problem

However, in order to change the emission color of the LED module 900 disclosed in PTL 1 according to light adjustment, it is necessary to appropriately instruct the base-emitter voltage of the bipolar transistor 924. A structure for appropriately instructing the base-emitter voltage requires not only current supply lines from the variable current source 933, but also circuit elements including signal lines for appropriately instructing voltage applied to the resistive element 925, the variable voltage source 927 and the resistive element 926. In other words, changing the emission color of the LED module 900 according to light adjustment disadvantageously requires a large number of circuit elements.

Furthermore, the disadvantage occurs not only in the case where the emission color is changed according to light adjustment, but also in the case where a plurality of LED arrays having different light distribution properties are arranged and the light distribution properties are changed according to light adjustment. More specifically, the disadvantage occurs in the case where a plurality of LED arrays are arranged to exhibit a rendered lighting effect, such as a change in emission color or a change in light distribution properties according to light adjustment.

The present invention has been conceived in view of the above disadvantage, and has an object to provide a light-emitting circuit, a light-emitting module, and a lighting apparatus which are capable of exhibiting a rendered lighting effect according to light adjustment, with reduced numbers of circuit components.

Solution to Problem

In order to solve the above object, a light-emitting circuit according to an aspect of the present invention is a light-emitting circuit which emits light in response to a variable current, the light being emitted according to the variable current. The light-emitting circuit includes: a first light-emitting unit which includes one or more first light-emitting elements connected in series, and through which a first branch current of the variable current flows; a second light-emitting unit which includes one or more second light-emitting elements connected in series, and through which a second branch current flows, the second branch current being a differential current between the variable current and the first branch current; and a current control element which is connected to the second light-emitting unit in series, and which adjusts the second branch current according to a differential voltage between a first total forward voltage and a second total forward voltage, the first total forward voltage being a sum of a forward voltage generated by each of the one or more first light-emitting elements, the first total forward voltage including the same number of the forward voltages as the number of the one or more first light-emitting elements, the second total forward voltage being a sum of a forward voltage generated by each of the one or more second light-emitting elements, the second total forward voltage including the same number of the forward voltages as the number of the one or more second light-emitting elements.

Furthermore, in the light-emitting circuit according to the aspect of the present invention, it may be that the one or more first light-emitting elements emit light of a first color, and the one or more second light-emitting elements emit light of a second color different from the first color.

Furthermore, in the light-emitting circuit according to the aspect of the present invention, it may be that the first light-emitting unit and the second light-emitting unit have different light distribution properties.

Furthermore, in the light-emitting circuit according to the aspect of the present invention, it may be that the one or more first light-emitting elements and the one or more second light-emitting elements have different layouts, and the different layouts cause the different light distribution properties.

Furthermore, in the light-emitting circuit according to the aspect of the present invention, it may be that the current control element has a first terminal, a second terminal, and a control terminal, the first terminal and the second terminal are provided on a path of the second branch current, and the current control element adjusts the second branch current corresponding to the differential voltage generated between the first terminal and the second terminal, in response to a control signal provided to the control terminal.

Furthermore, in the light-emitting circuit according to the aspect of the present invention, it may be that the current control element is an NPN bipolar transistor, the control terminal is a base terminal, the first terminal is a collector terminal, and the second terminal is an emitter terminal, and the first terminal is provided closer to a higher potential side of the path of the second branch current than the second terminal is, and the control terminal and the first terminal are connected via a resistive element.

Furthermore, in the light-emitting circuit according to the aspect of the present invention, it may be that the current control element is a PNP bipolar transistor, the control terminal is a base terminal, the first terminal is an emitter terminal, and the second terminal is a collector terminal, the first terminal is provided closer to a higher potential side of the path of the second branch current than the second terminal is, and the control terminal and the second terminal are connected via a resistive element.

Furthermore, in the light-emitting circuit according to the aspect of the present invention, it may be that the first light-emitting unit has a first anode terminal at an anode side and a first cathode terminal at a cathode side, the second light-emitting unit has a second anode terminal at an anode side and a second cathode terminal at a cathode side, the first terminal and the first anode terminal are connected to a higher potential terminal of a variable current source which supplies the variable current, the second terminal and the second anode terminal are connected to each other, and the first cathode terminal and the second cathode terminal are connected to a lower potential terminal of the variable current source.

Furthermore, in the light-emitting circuit according to the aspect of the present invention, it may be that the current control element is a resistive element.

Furthermore, in the light-emitting circuit according to the aspect of the present invention, it may be that the first light-emitting unit has a first anode terminal at an anode side and a first cathode terminal at a cathode side, the second light-emitting unit has a second anode terminal at an anode side and a second cathode terminal at a cathode side, the first anode terminal and a first terminal of the resistive element are connected to a higher potential terminal of a variable current source which supplies the variable current, the second anode terminal and a second terminal of the resistive element are connected to each other, and the first cathode terminal and the second cathode terminal are connected to a lower potential terminal of the variable current source.

Furthermore, in the light-emitting circuit according to the aspect of the present invention, it may be that a change rate of the second branch current relative to a change in the variable current is lower than a change rate of the first branch current relative to the change in the variable current.

Furthermore, in the light-emitting circuit according to the aspect of the present invention, it may be that the first color is white, and the second color is red.

Furthermore, a light-emitting module according to an aspect of the present invention includes a mounting board, and the light-emitting circuit located on the mounting board.

Furthermore, a lighting apparatus according to an aspect of the present invention includes a light adjuster which generates, by using an alternating-current (AC) source, an AC light adjusting signal which represents a level of light adjustment; a variable current source which generates the variable current according to the AC light adjusting signal; and the light-emitting module receiving the variable current from the variable current source.

Advantageous Effects

According to the light-emitting circuit, the light-emitting module, and the lighting apparatus in the present invention, rate of change of second branch current relative to a change in variable current is lower than rate of change of first branch current relative to the change in the variable current, due to the current control element provided on the path of the second branch current. Hence, the ratio of the first branch current to the second branch current relative to the change in the variable current changes. This allows exhibition of a rendered lighting effect in accordance with luminance change, with reduced numbers of wiring, such as signal lines, and reduced numbers of circuit components.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS

Figure 1A:
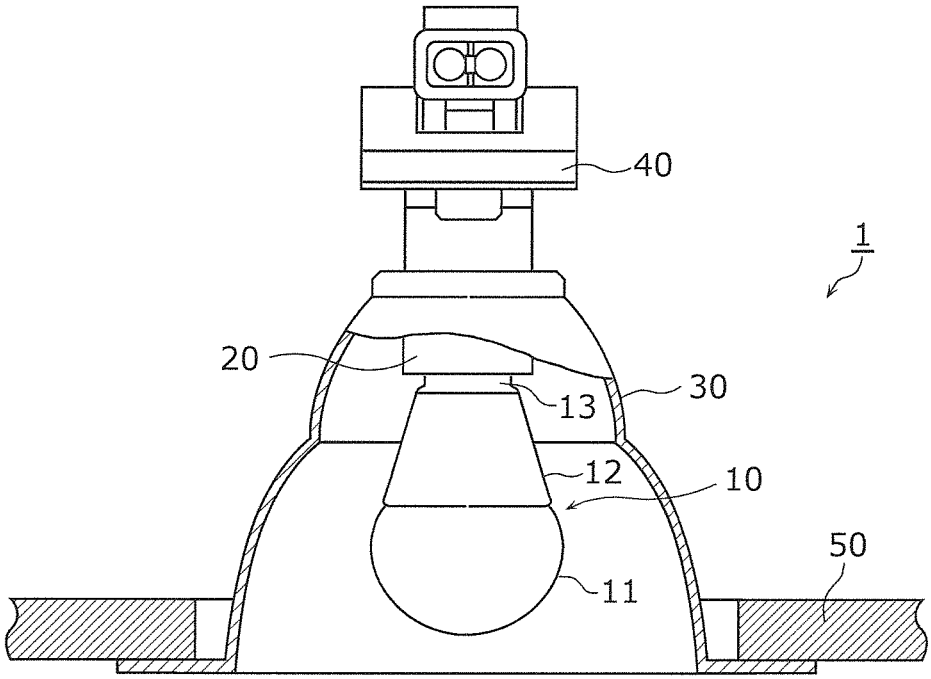
FIG. 1A is a cross-sectional view of a lighting apparatus including a lamp having an LED module according to Embodiment 1.

Hereinafter, descriptions are given of a light-emitting circuit, a light-emitting module, and a lighting apparatus according to embodiments of the present invention, referring to the drawings. The following embodiments describe one specific example of the present invention. Hence, the numerical values, shapes, materials, structural elements, the arrangement and connection of the structural elements etc. shown in the following embodiments are mere examples, and therefore do not limit the scope of the present invention. Therefore, among the structural elements in the following embodiments, structural elements not recited in any one of the independent claims are described as arbitrary structural elements.

Embodiment 1

[Configuration of Lighting Apparatus]

FIG. 1A is a cross-sectional view of a lighting apparatus including a lamp having an LED module according to Embodiment 1. As shown in FIG. 1A, an LED lamp 10 is attached to a lighting apparatus 1. The LED lamp 10 includes a globe 11, an outer case 12, and a base 13, and houses an LED module 100 (not shown in FIG. 1A). Furthermore, a driving circuit (not shown in FIG. 1A), which includes a variable current source, is provided inside the outer case 12 and the base 13. The variable current source generates variable current according to an AC light adjusting signal provided from a light adjuster to supply the variable current to the LED module 100. With the configuration, variable current is supplied to the LED module 100 in accordance with the light adjusting control, and light emitted from the LED lamp 10 is adjusted.

The lighting apparatus 1 includes: the LED lamp 10; a socket 20 which is electrically connected to the LED lamp 10 and which holds the LED lamp 10; and a bowl-shaped reflective plate 30 which reflects light emitted from the LED lamp 10 into a predetermined direction. Furthermore, the lighting apparatus 1 includes a light adjuster (not shown in FIG. 1A) which generates, by using the AC source, an AC light adjusting signal representing the level of light adjustment. As an example of the lighting apparatus 1 according to Embodiment 1, a so-called downlight lighting appliance is shown.

The lighting apparatus 1 is connected to an external AC source via a connecting portion 40. The reflective plate 30 is attached to a ceiling 50 while the reflective plate 30 abuts the lower surface of the peripheral portion of the opening of the ceiling 50. The socket 20 provided above the reflective plate 30 is located at the back side of the ceiling 50.

Note that the configuration of the lighting apparatus 1 shown in FIG. 1A is a mere example, and the lighting apparatus 1 is not limited to the above downlight lighting appliance.

[Configuration of Light-Emitting Module]

Figure 1B:
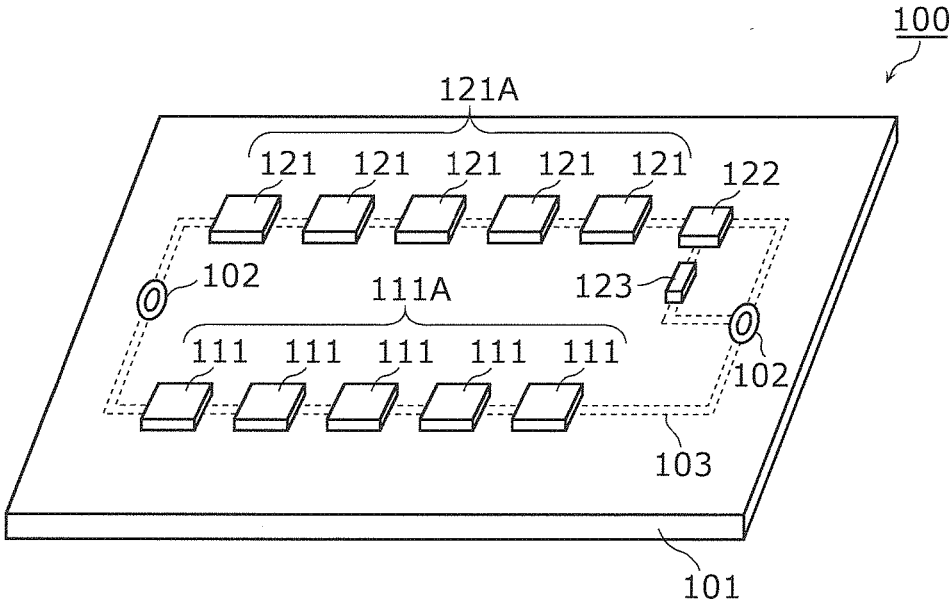
FIG. 1B is a perspective view of the LED module according to Embodiment 1.

FIG. 1B is a perspective view of the LED module according to Embodiment 1. As shown in FIG. 1B, the LED module 100 is a light-emitting module including: a mounting board 101; a plurality of LEDs 111 connected in series; a plurality of LEDs 121 connected in series and emit light of a color different from that of the LEDs 111; a transistor 122; and a resistive element 123. The LEDs 111 connected in series compose an LED array 111A, and the LEDs 121 connected in series compose an LED array 121A. Each of the LEDs 111 is a first light-emitting element which includes, for example, a blue LED chip and a sealing material including a yellow phosphor, and which emits white light. Each of the LEDs 121 is a second light-emitting element which includes, for example, a blue LED chip and a sealing material including a red phosphor and a green phosphor, and which emits red light. The sealing material is formed of, for example, a translucent material, such as silicon resin, and a phosphor. FIG. 1B shows five LEDs 111 and five LEDs 121; however, the number of LEDs may vary.

The mounting board 101 has a wiring pattern 103 which allows wiring to be connected to the LEDs 111 and the LEDs 121. Furthermore, the mounting board 101 has a through-hole 102. The wiring connected to, for example, the LEDs 111 and the LEDs 121 is connected to the driving circuit provided inside the outer case 12 and the base 13 of the LED lamp 10, through the through-hole 102. The wiring is soldered at the through-hole 102 to be fixed to the mounting board 101.

The shape of the mounting board 101 may be other than quadrilateral as shown in FIG. 1B. The shape of the mounting board 101 may be, for example, circular or elliptical, corresponding to the shape of the LED lamp 10 to be mounted. The LED arrays 111A and 121A may have layouts other than linear as shown in FIG. 1B. The LED arrays 111A and 121A may be, for example, circular or elliptical corresponding to the shape of the LED lamp 10 to be mounted, or may have a layout in which the LEDs 111 and the LEDs 121 are alternately arranged while maintaining the above electrical connection in the LED arrays 111A and 121A.

[Configuration of Light-Emitting Circuit]

Figure 2:
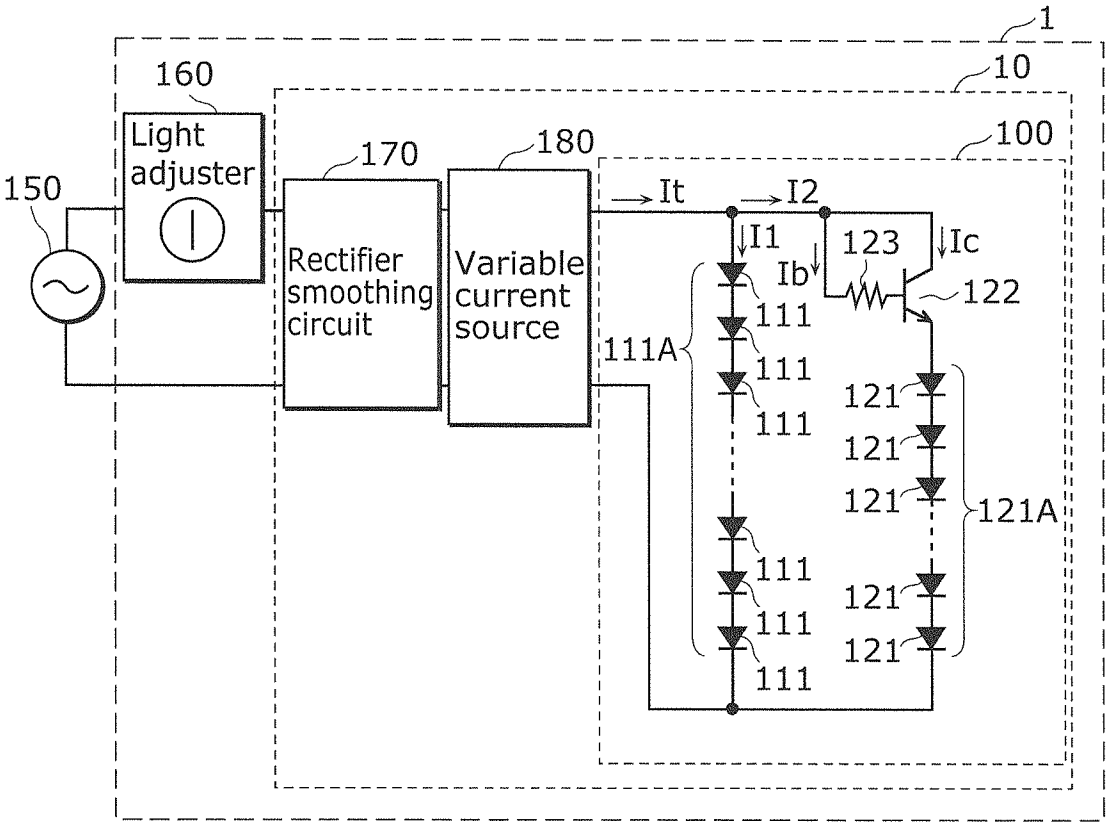
FIG. 2 is a circuit configuration diagram of the LED module according to Embodiment 1.

FIG. 2 is a circuit configuration diagram of the LED module according to Embodiment 1. As shown in FIG. 2, the lighting apparatus 1 includes a light adjuster 160 and the LED lamp 10.

The AC source 150 outputs, for example, AC voltage with an effective value of 100 V.

The light adjuster 160 is a phase-control light adjuster which converts the AC signal supplied from the AC source 150 into an AC light adjusting signal which is a signal of the AC voltage waveform which is partially cut out. The light adjuster 160 controls phase of the AC signal according to the level of light adjustment to convert the AC signal into the AC light adjusting signal. More specifically, the light adjuster 160 generates, from the input AC signal, a light adjusting signal having a zero voltage within a phase angle range which corresponds to the light adjusting level. Referring to FIG. 4C, a description will be given later of a specific waveform of the AC light adjusting signal. The light adjusting operation is, for example, performed by a user operating a light adjusting device or the like provided on the wall. With this, the level of the DC variable current It provided from the variable current source 180 to the LED module 100 changes based on the level of the AC light adjusting voltage having a phase controlled by the light adjuster 160.

The LED lamp 10 includes a rectifier smoothing circuit 170, the variable current source 180, and the LED module 100.

The rectifier smoothing circuit 170 includes, for example, a rectifier circuit formed of a diode bridge, and a smoothing circuit formed of a capacitor. The rectifier smoothing circuit 170 rectifies and smoothes the AC light adjusting signal provided from the light adjuster 160.

The variable current source 180 generates AC variable current according to the light adjusting signal rectified and smoothed by the rectifier smoothing circuit 170, and supplies the generated current to the LED module 100. More specifically, for example, the variable current is increased through the operation of the light adjuster to make the room brighter, and the variable current is reduced through the operation of the light adjuster to make the room darker.

The LED module 100 includes a light-emitting circuit which includes: the LED array 111A including the LEDs 111 connected in series; the LED array 121A including the LEDs 121 connected in series; the transistor 122 having a collector terminal and an emitter terminal connected in series to the LED array 121A; and the resistive element 123 which connects the collector terminal and the base terminal of the transistor 122. Examples of the transistor 122 include an NPN bipolar transistor.

A first anode terminal at the anode side of the LED array 111A and the collector terminal of the transistor 122 are connected to the higher potential terminal of the variable current source 180. A first cathode terminal at the cathode side of the LED array 111A and a second cathode terminal at the cathode side of the LED array 121A are connected to the lower potential terminal of the variable current source 180. A second anode terminal at the anode side of the LED array 121A is connected to the emitter terminal of the transistor 122. In other words, the circuit of the LED array 111A and the series circuit of the LED array 121A and the transistor 122 are connected in parallel between the higher potential terminal and the lower potential terminal of the variable current source 180.

Such a circuit configuration branches the DC variable current It provided from the variable current source 180 into first branch current I1 which flows through a first light-emitting unit formed of the LED array 111A and second branch current I2 which flows through a second light-emitting unit formed of the LED array 121A.

Each of the LEDs 111 included in the LED array 111A is the first light-emitting element, and generates forward voltage Vt1 in response to the first branch current I1. Each of the LEDs 121 included in the LED array 121A is the second light-emitting element, and generates forward voltage Vt2 in response to the second branch current I2. The forward voltage Vt1 of the LED 111 which emits white light is, for example, 3.5 V (in the case where a blue LED chip is used), while the forward voltage Vt2 of the LED 121 which emits red light is, for example, 2.1 V (in the case where a red LED chip is used).

Here, suppose a case where six LEDs 111 and six LEDs 111 are arranged. In this case, first total forward voltage obtained by serial addition of the forward voltages Vt1 generated in the LED array 111A is 21.0 V (3.5 V×6 (the number of LEDs 111)), and second total forward voltage obtained by serial addition of the forward voltages Vt2 generated in the LED array 121A is 12.6 V (2.1 V×6 (the number of LEDs 121)). In a predetermined range of the DC variable current It, the forward voltage Vt1 is almost constant relative to a change in the first branch current I1, and the forward voltage V2 is almost constant relative to a change in the second branch current I2.

Hence, in the case where the DC variable current It is supplied from the variable current source 180 to the LED module 100, 8.4 V (21.0 V-12.6 V), which is differential voltage Vd between the first total forward voltage and the second total forward voltage, is always generated between the path of the first branch current I1 and the path of the second branch current I2 in the predetermined current range. The differential voltage Vd becomes collector-emitter voltage $V_{CE}$ of the transistor 122. Collector current Ic and base current Ib corresponding to the differential voltage Vd generated between the collector and the emitter flow through the resistive element 123. More specifically, the transistor 122 is a current control element which is connected in series to the LED array 121A and which adjusts the value of the second branch current I2 according to the differential voltage Vd between the first total forward voltage and the second total forward voltage. The first total forward voltage is the sum of the forward voltages Vt1, and includes the same number of the forward voltages Vt1 as the number of the LEDs 111 in the LED array 111A. The second total forward voltage is the sum of the second total forward voltages, and includes the same number of the second forward voltages as the number of the LEDs 121 in the LED array 121A.

According to the above operation of the transistor 122, the differential voltage Vd determined by the configuration of the LED array 111A and the LED array 121A is almost constant in the predetermined current range. Accordingly, the base current Ib and the collector current Ic are maintained almost constant, which makes the second branch current I2 almost constant in the predetermined current range even if the DC variable current It changes. Hence, the change in the DC variable current It almost equals to the change in the first branch current I1. More specifically, in a predetermined light adjusting range, the change rate of the second branch current I2 relative to the change in the light adjusting level is lower than the change rate of the DC variable current It relative to the change in the light adjusting level. Due to the difference between (i) the change in the first branch current I1 relative to the change in the DC variable current It and (ii) the change in the second branch current I2 relative to the change in the DC variable current It, the ratio of the first branch current to the second branch current I2 changes in response to the change in the DC variable current It. More specifically, by changing, according to the light adjusting level, ratio of current flowing through two types of the LEDs 111 and the LEDs 121 which emit different colors, it is possible to change the emission color of the LED module 100 in accordance with the light adjusting operation.

Furthermore, the circuit components required for the above light-emitting circuit are, other than the LEDs serving as the light-emitting elements, only the transistor 122 and the resistive element 123. As a result, it is possible to change the emission color according to the light adjusting level, with reduced numbers of circuit elements including the variable voltage circuit for changing the base-collector voltage or the base-emitter voltage of the transistor 122 and signal lines.

Furthermore, the NPN bipolar transistor is shown as an example of the transistor 122 according to Embodiment 1, however, the transistor 122 may be a PNP bipolar transistor. More specifically, in such a case, the anode terminal of the LED array 111A and the emitter terminal of the PNP bipolar transistor are connected to the higher potential terminal of the variable current source 180. The cathode terminal of the LED array 111A and the cathode terminal of the LED array 121A are connected to the lower potential terminal of the variable current source 180. The anode terminal of the LED array 121A is connected to the collector terminal of the PNP bipolar transistor. The base terminal and the collector terminal of the PNP bipolar transistor are connected via a resistive element. Such a configuration also produces the similar advantageous effects to those produced in the case where the transistor 122 is an NPN bipolar transistor.

More specifically, the transistor 122 includes a first terminal, a second terminal, and a control terminal. The first terminal and the second terminal are provided on the path of the second branch current I2. In response to a control signal provided to the control terminal, the transistor 122 adjusts the second branch current I2 corresponding to the differential voltage generated between the first terminal and the second terminal.

Here, in the case where the transistor 122 is an NPN bipolar transistor, the control terminal corresponds to the base terminal, the first terminal corresponds to the collector terminal, and the second terminal corresponds to the emitter terminal. The collector terminal is provided closer to the higher potential side of the path of the second branch current I2 than the emitter terminal is, and the base terminal and the collector terminal are connected via the resistive element.

In the case where the transistor 122 is a PNP bipolar transistor, the control terminal corresponds to the base terminal, the first terminal corresponds to the emitter terminal, and the second terminal corresponds to the collector terminal. The emitter terminal is provided closer to the higher potential side of the path of the second branch current I2 than the collector terminal is, and the base terminal and the collector terminal are connected via the resistive element.

The transistor 122 may be a field effect transistor. In this case, for example, the drain terminal and the source terminal of the field effect transistor are provided on the path of the second branch current I2 so that voltage corresponding to the differential voltage Vd is applied between the gate and source. Such a configuration produces the similar advantageous effects to those produced in the case where the transistor 122 is a bipolar transistor.

[Characteristics of Light-Emitting Module]

Figure 3A:
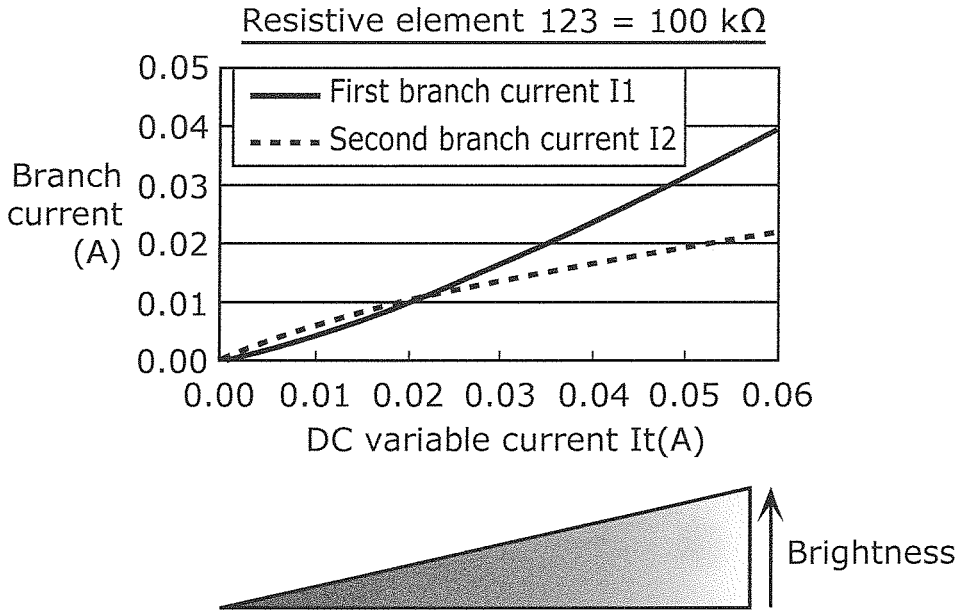
FIG. 3A is a graph representing current characteristics of the LED module according to Embodiment 1 when a resistive element has a resistance value of 100 kΩ.
Figure 3B:
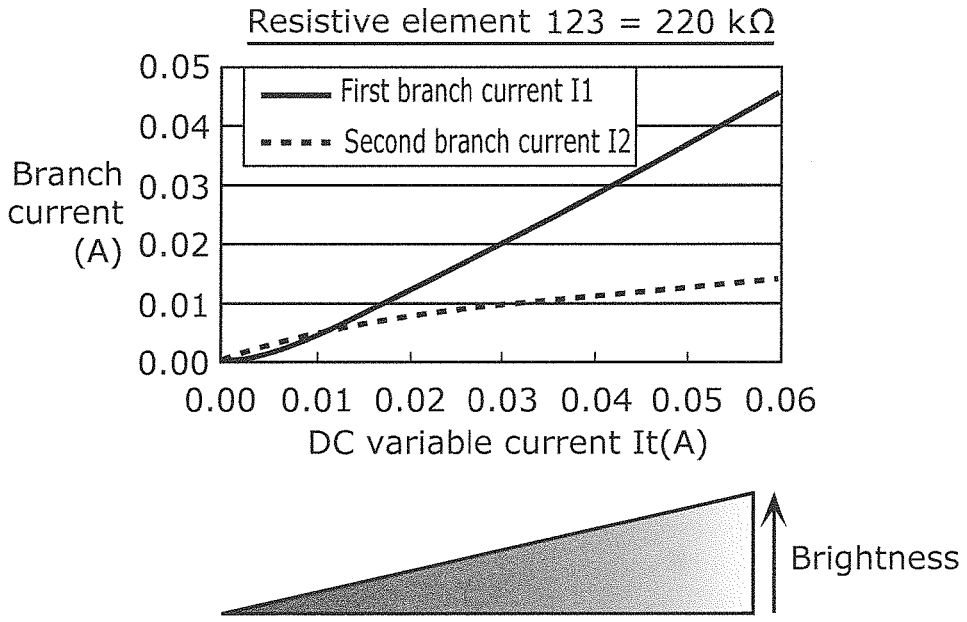
FIG. 3B is a graph representing current characteristics of the LED module according to Embodiment 1 when the resistive element has a resistance value of 220 kΩ.
Figure 3C:
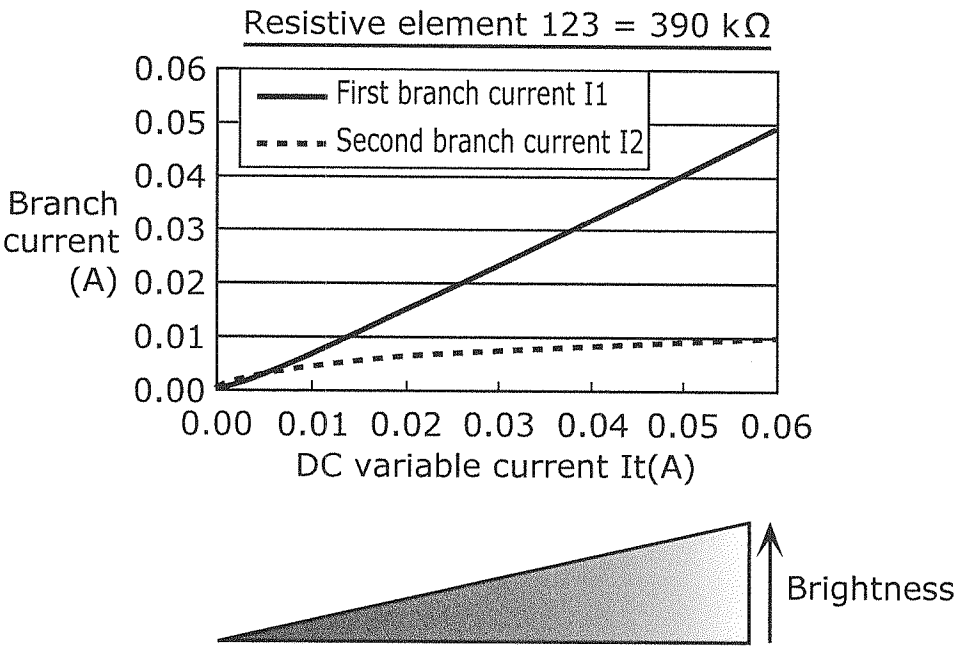
FIG. 3C is a graph representing current characteristics of the LED module according to Embodiment 1 when the resistive element has a resistance value of 390 kΩ.

FIG. 3A, FIG. 3B, and FIG. 3C show graphs representing current characteristics of the LED module according to Embodiment 1 when the resistive element has a resistive value of 100 kΩ, 220 kΩ, and 390 kΩ, respectively. In each of FIG. 3A, FIG. 3B, and FIG. 3C, the horizontal axis represents the DC variable current It supplied from the variable current source 180 according to the light adjusting operation, and the vertical axis represents the first branch current It and the second branch current I2 flowing through the LED module 100. The current characteristics of the LED module 100 shown in FIG. 3A, FIG. 3B, and FIG. 3C are results of the simulations of the circuit configuration described below. Each LED 111 has a forward voltage Vt1 of approximately 3 V, and a white phosphor (color temperature of 6500 K). The LED array 111A includes sixteen LEDs 111 connected in series. Each LED 121 has a forward voltage Vt2 of approximately 3 V, and an orange phosphor (color temperature of 2200 K). The LED array 121A includes fourteen LEDs 121 connected in series. Such a configuration results in the first total forward voltage of 48 V (Vt1×the number of LEDs 111) and the second total forward voltage of 42 V (Vt2×the number of LEDs 121). As a result, the differential voltage Vd is 6V.

In the above configuration, as shown in FIG. 3A to FIG. 3C, the rate of increase in the second branch current I2 relative to an increase in the DC variable current It is lower than the rate of increase in the first branch current I1 relative to the increase in the DC variable current It. This is due to the following reason: as mentioned in the description of the circuit configuration of the LED module, the differential voltage Vd keeps the base current Ib and the collector current Ic to almost constant values. Hence, a change in the DC variable current It in a predetermined current range causes a small change (almost no change) in the second brunch current I2. The change in the second branch current I2 relative to the change in the DC variable current It is small, whereas the change in the first branch current I1 is almost equal to the change in the DC variable current It. More specifically, the graphs in FIG. 3A to FIG. 3C show that an increase in the ratio of the first branch current I1 with an increase in the DC variable current It causes color temperature, that is, emission color to be changed with an increase in luminance. According to the configuration example of the LED set in the simulations, the emission color of the LED lamp 10 approaches white by setting luminance higher through the light adjusting operation, and approaches orange by setting luminance lower.

Furthermore, as the resistive value of the resistive element 123 increases, the ratio of the first branch current I1 increases with an increase in the DC variable current It. This is because the base current Ib, flowing through the resistive element 123 which has a voltage drop corresponding to the differential voltage Vd, decreases as the resistive value increases, resulting in a decrease in the collector current Ic and the second branch current I2.

Figure 4A:
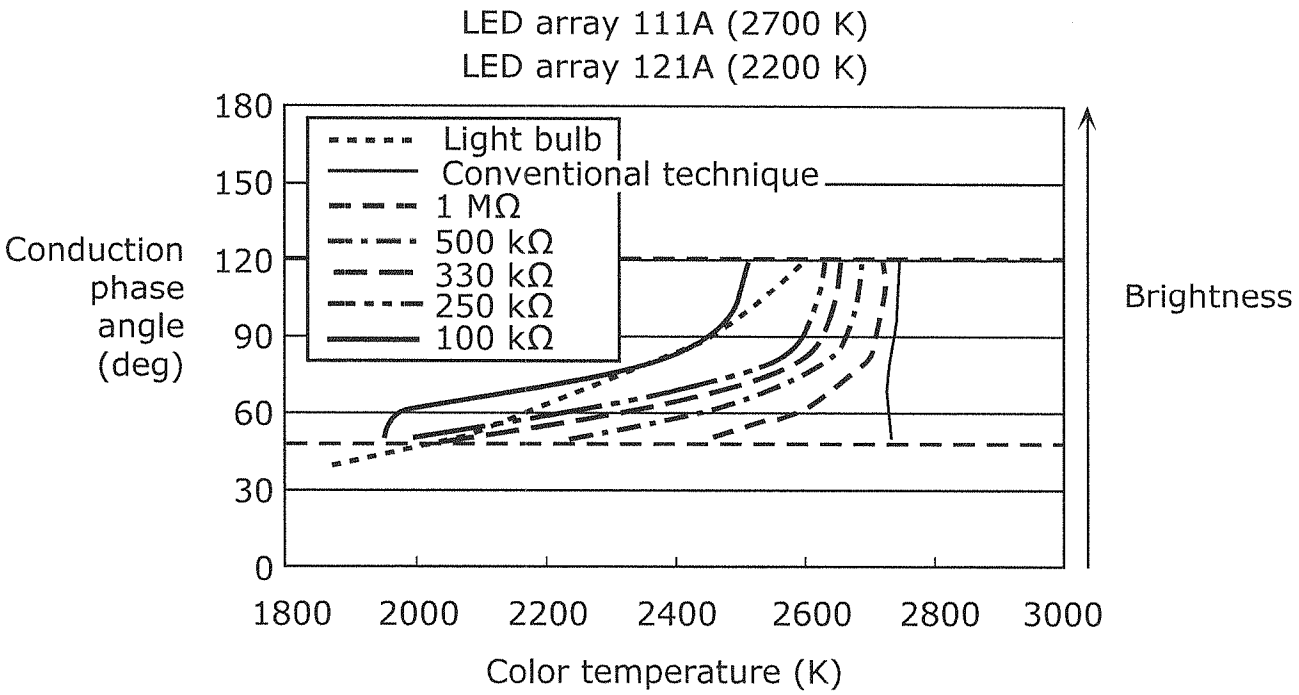
FIG. 4A is a graph representing first color temperature characteristics of the LED module according to Embodiment 1.
Figure 4B:
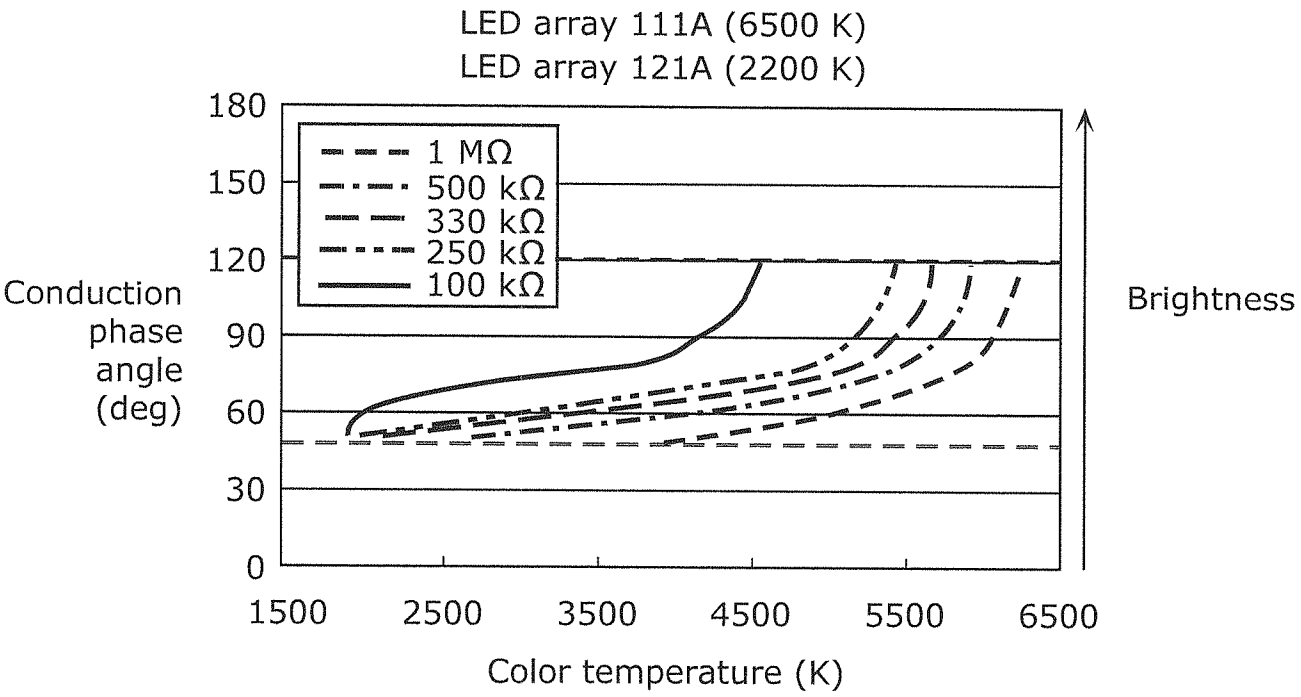
FIG. 4B is a graph representing second color temperature characteristics of the LED module according to Embodiment 1.
Figure 4C:
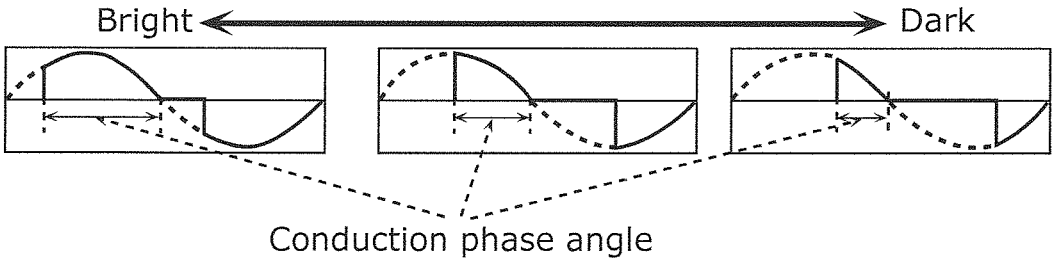
FIG. 4C illustrates conduction phase angle of an AC light adjusting signal.

FIG. 4A and FIG. 4B show graphs representing first and second color temperature characteristics of the LED module according to Embodiment 1. FIG. 4C illustrates conduction phase angle of an AC light adjusting signal. In each of FIG. 4A and FIG. 4B, the horizontal axis represents color temperature of the LED module, and the vertical axis represents conduction phase angle of an AC light adjusting signal provided from the light adjuster 160.

Here, a brief description is given of the conduction phase angle. In each diagram shown in FIG. 4C, relative to the phase angle 0 degrees that is the phase when AC voltage supplied from the AC source becomes 0 V from negative voltage (also referred to as zero crossing), voltage of 0 V is set in the range from the above phase angle to the phase angle corresponding to the instructed light adjusting level. At the phase angle corresponding to the instructed light adjusting level, the voltage of the light adjusting signal is raised to the AC voltage supplied from the AC source 150. Here, the angle range from the phase angle at which the light adjuster 160 raises the light adjusting signal to the phase angle 180 degrees is defined as the conduction phase angle. More specifically, for example, when the room is to be brightened, the conduction phase angle increases through a light adjusting operation, and when the room is to be darken, the conduction phase angle decreases through a light adjusting operation.

The graph in FIG. 4A shows color temperature of light emitted from the LED module 100 shown in FIG. 2 where the LED array 111A includes LEDs 111 which are serially connected and each of which has a color temperature of 2700 K and the LED array 121A includes the LEDs 121 which are serially connected and each of which has a color temperature of 2200 K.

In the conventional configuration where no light adjusting function is provided or a variable voltage circuit does not operate in accordance with a change in conduction phase angle even if the light adjusting function is provided, the color temperature is almost constant relative to a change in conduction phase angle; and therefore, the emission color does not change relative to a change in light adjustment.

On the other hand, in the LED module 100 according to this embodiment, the color temperature changes relative to the change in the conduction phase angle, within the color temperature range reflecting the color temperatures of the LEDs 111 and the LEDs 121. Furthermore, as the resistance value of the resistive element 123 increases, the color temperature of the LED module 100 approaches closer to the color temperature of the LEDs 111. As the resistance value of the resistive element 123 decreases, the color temperature range of the LED module 100 increases. In particular, when the resistive element 123 has 100 kΩ, the color temperature characteristics similar to those of the incandescent light bulb are achieved.

The graph in FIG. 4B shows color temperature of light emitted from the LED module 100 shown in FIG. 2 where the LED array 111A includes LEDs 111 which are serially connected and each of which has a color temperature of 6500 K and the LED array 121A includes the LEDs 121 which are serially connected and each of which has a color temperature of 2200 K. In the LED module 100 according to this embodiment, the color temperature changes relative to the change in the conduction phase angle, within the color temperature range reflecting the color temperatures of the LEDs 111 and the LEDs 121. Furthermore, as the resistance value of the resistive element 123 increases, the color temperature of the LED module 100 approaches closer to the color temperature of the LEDs 111. As the resistance value of the resistive element 123 decreases, the color temperature of the LED module 100 shifts to lower color temperature.

As described above, in the LED module 100 according to this embodiment, appropriate selections are made on the emission color and color temperature of the LEDs 111 and the LEDs 121, the number of the LEDs 111 and the LEDs 121 connected in series, and the resistance value of the resistive element connected to the base terminal of the transistor. Such a selection leads to an intended change in emission color according to the change in light adjusting level, with reduced numbers of circuit components other than the LEDs. More specifically, by providing a plurality of LED arrays having different total forward voltages, it is possible to exhibit a rendered lighting effect, such as a change in emission color according to light adjustment, with reduced numbers of circuit components.

In this embodiment, simulations were conducted under the assumption that the LED array 111A and the LED array 121A have different numbers of serial connections; however, the LED module according to the present invention is not limited to such an example. Examples of the LED module according to the present invention include an LED module including the LED array 111A and the LED array 121 having the same number of serial connections but having different forward voltages. In such a case, the differential voltage Vd is generated, which produces the advantageous effects similar to the LED module with the above configuration where the LED array 111A and the LED array 121A have different numbers of serial connections.

Embodiment 2

The LED module 100 according to Embodiment 1 includes a transistor serving as a current control element. However, the current control element is not limited to the transistor. For example, the current control element may be a resistive element having two terminals.

Hereinafter, referring to the drawings, a description is given of an LED module 130 which includes a resistive element according to Embodiment 2. The followings will mainly describe configurations different from that of the LED module 100 according to Embodiment 1, omitting the descriptions of the same configuration.

The LED module 130 includes: a mounting board 101; a plurality of LEDs 111 which are connected in series; a plurality of LEDs 121 which are connected in series and emit color different from that of the LEDs 111; and a resistive element 124.

[Circuit Configuration of Light-Emitting Module]

Figure 5:
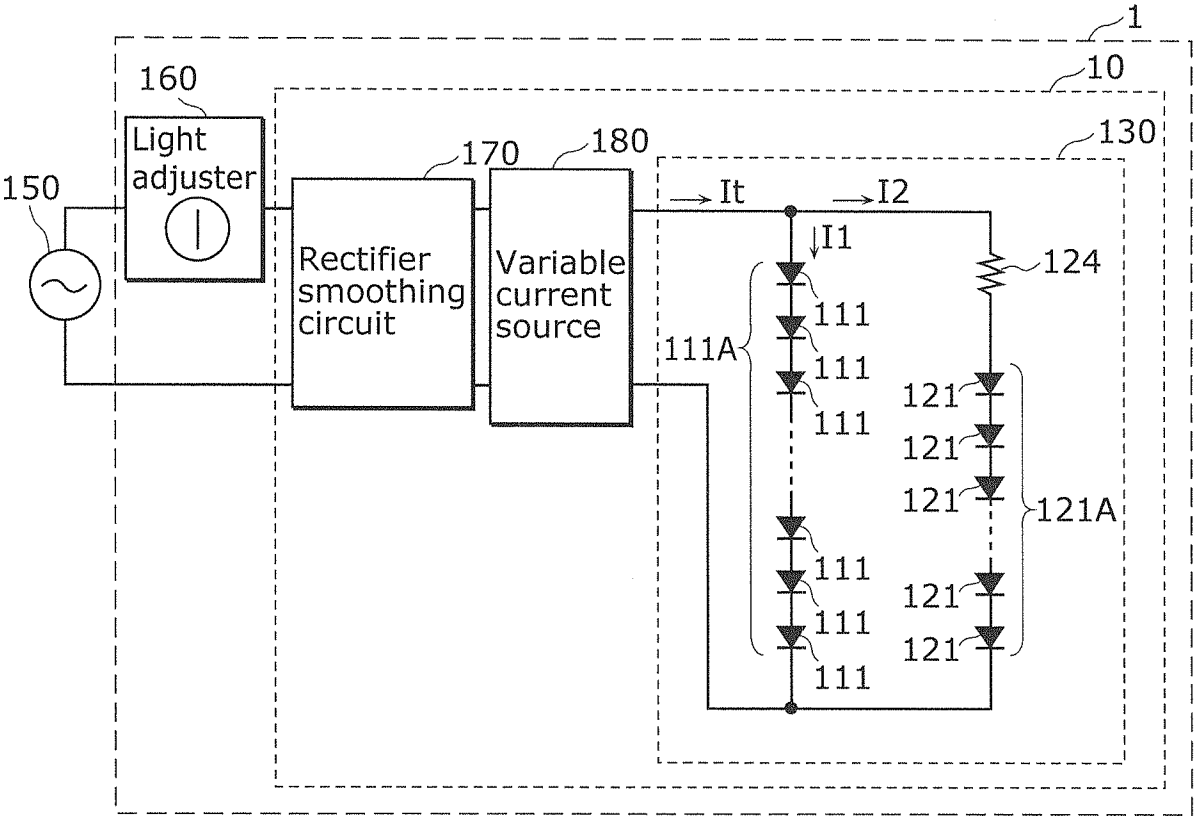
FIG. 5 is a circuit configuration diagram of an LED module according to Embodiment 2.

FIG. 5 is a circuit configuration diagram of the LED module according to Embodiment 2. As shown in FIG. 5, the LED module 130 includes a light-emitting circuit including: an LED array 111A including a plurality of the LEDs 111 which are connected in series; a plurality of the LEDs 121 which are connected in series; and a resistive element 124 connected in series to the LED array 121A.

A first anode terminal at the anode side of the LED array 111A and a first terminal of the resistive element 124 are connected to the higher potential terminal of the variable current source 180. A first cathode terminal at the cathode side of the LED array 111A and a second cathode terminal at the cathode side of the LED array 121A are connected to the lower potential terminal of the variable current source 180. A second anode terminal at the anode side of the LED array 121A is connected to a second terminal of the resistive element 124. In other words, the circuit of the LED array 111A and the series circuit of the LED array 121A and the resistive element 124 are connected in parallel between the higher potential terminal and the lower potential terminal of the variable current source 180.

Such a circuit configuration branches the DC variable current It provided from the variable current source 180 into first branch current I1 which flows through a first light-emitting unit formed of the LED array 111A and second branch current I2 which flows through a second light-emitting unit formed of the LED array 121A.

Each of the LEDs 111 included in the LED array 111A is a first light-emitting element, and generates forward voltage Vt1 in response to the first branch current I1. Each of the LEDs 121 included in the LED array 121A is a second light-emitting element, and generates forward voltage Vt2 in response to the second branch current I2. The forward voltage Vt1 of the LED 111 which emits white light is, for example, 3.5 V (in the case where a blue LED chip is used). The forward voltage Vt2 of the LED 121 which emits red light is, for example, 2.1 V (in the case where a red LED chip is used).

Here, suppose a case where six LEDs 111 and six LEDs 121 are arranged. In this case, first total forward voltage obtained by serial addition of the forward voltages Vt1 generated in the LED array 111A is 21.0 V, and second total forward voltage obtained by serial addition of the forward voltages Vt2 generated in the LED array 121A is 12.6 V. In a predetermined range of the DC variable current It, the forward voltage Vt1 is almost constant relative to a change in the first branch current I1, and the forward voltage V2 is almost constant relative to a change in the second branch current I2.

Hence, in the case where variable current is supplied from the variable current source 180 to the LED module 130, voltage of 8.4 V, which is differential voltage between the first total forward voltage and the second total forward voltage, is always generated between the path of the first branch current I1 and the path of the second branch current I2 in the predetermined current range. As a result, the resistive element 124 always has a voltage drop corresponding to the differential voltage Vd. In other words, the second branch current I2, which generates the differential voltage Vd in the resistive element 124, flows through the resistive element 124. More specifically, the resistive element 124 is a current control element which is connected in series to the LED array 121A and which adjusts the second branch current I2 according to the differential voltage Vd between the first total forward voltage and the second total forward voltage. The first total forward voltage is the sum of the forward voltages Vt1 and includes the same number of forward voltages Vt1 as the number of the LEDs 111 in the LED array 111A. The second total forward voltage is the sum of the forward voltages Vt2 and includes the same number of the forward voltages Vt2 as the number of the LEDs 121 in the LED array 121A.

With the above arrangement of the resistive element 124, the differential voltage Vd determined by the configuration of the LED array 111A and the LED array 121A keeps the second branch current I2 to an almost constant value. Hence, the second brunch current I2 changes little even if the DC variable current It changes in a predetermined current range. Hence, the change in the DC variable current It is reflected in the change in the first branch current I1. Accordingly, a change in the level of the DC variable current It leads to a change in the ratio of the first branch current I1 to the second branch current I2 in the DC variable current It. More specifically, a change in the ratio of current flowing through two types of LEDs having different emission colors allows the emission colors to be changed in accordance with the light adjusting operation.

Furthermore, a circuit component required for the above light-emitting circuit is only the resistive element 124, other than the LEDs serving as the light-emitting elements. Hence, it is possible to change the emission color according to the light adjusting level, with reduced numbers of wiring such as signal lines or circuit components.

[Characteristics of Light-Emitting Module]

Figure 6:
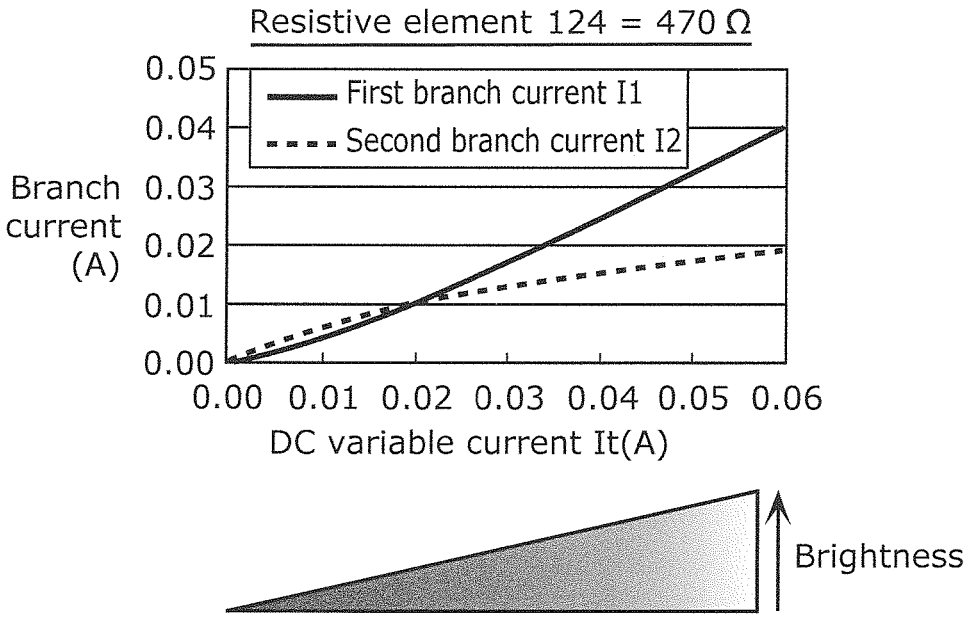
FIG. 6 is a graph representing current characteristics of the LED module according to Embodiment 2.

FIG. 6 is a graph representing current characteristics of the LED module according to Embodiment 2. In FIG. 6, the horizontal axis represents DC variable current It supplied from the variable current source 180 according to a light adjusting operation, and the vertical axis represents the first branch current I1 and the second branch current I2 flowing through the LED module 130. The current characteristics of the LED module 130 shown in FIG. 6 are results of the simulations of the circuit configuration described below. The forward voltages and the phosphors of the LEDs 111 and 121 and the number of serial connections of the LED arrays 111A and 121A according to Embodiment 2 are the substantially same as those in Embodiment 1. Such a configuration results in the first total forward voltage of 48 V (Vt1×the number of LEDs 111) and the second total forward voltage of 42 V (Vt2×the number of LEDs 121). As a result, the differential voltage Vd is 6 V.

In the above configuration, as shown in FIG. 6, the rate of increase in the second branch current I2 relative to an increase in the DC variable current It is lower than the rate of increase in the first branch current I1 relative to the increase in the DC variable current It. This is due to the following reasons: as mentioned in the description of the circuit configuration of the LED module, almost constant differential voltage Vd causes a small change in the second brunch current I2 (maintains an almost constant value of the second branch current I2). Hence, a change in the DC variable current It in a predetermined current range causes little change in the second branch current I2. Accordingly, the change in the DC variable current It is reflected in the change in the first branch current I1. More specifically, the graph in FIG. 6 shows that an increase in the ratio of the first branch current I1 with an increase in the DC variable current It causes color temperature, that is, emission color to be changed with an increase in luminance. According to the configuration example of the LED set in the above simulation, the emission color of the LED lamp 10 approaches white by setting luminance higher through a light adjusting operation, and approaches orange by setting luminance lower.

Embodiment 3

In Embodiments 1 and 2, descriptions have been given of the arrangement of the current control elements of the lighting apparatus and the LED module which exhibit rendered lighting effects including a change in emission color and color temperature by changing, according to the light adjusting level, the ratio of the branch current flowing through the two LED arrays having different emission colors. In Embodiment 3, a description is given of arrangements of current control elements of a lighting apparatus and an LED module which exhibit rendered lighting effects including a change in light distribution properties by changing, according to the light adjusting level, the ratio of the branch current flowing through two LED arrays having different light distribution properties.

Hereinafter, referring to the drawings, a description is given of an LED module which includes a current control element according to Embodiment 3. The followings will mainly describe different configurations from the LED module 100 according to Embodiment 1, omitting the descriptions of the same configuration.

[Configuration of LED Lamp]

Figure 7:
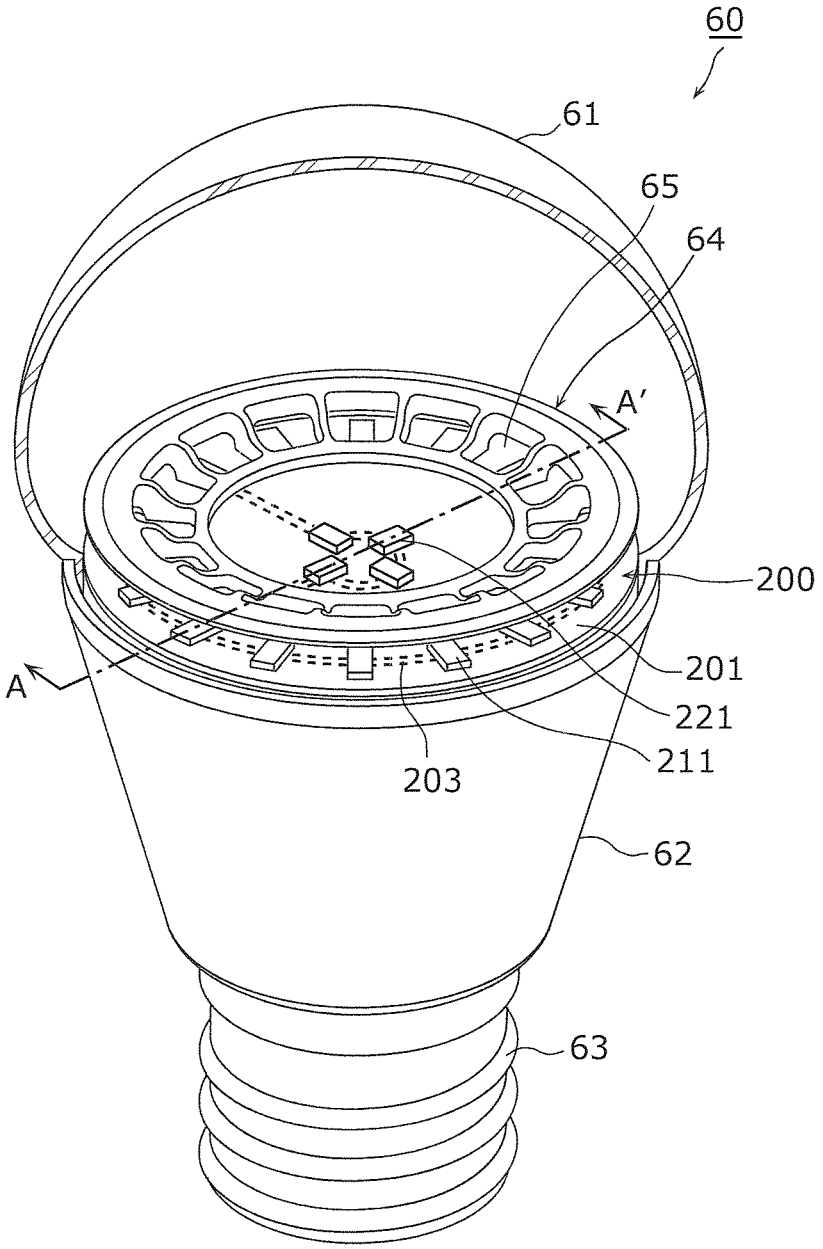
FIG. 7 is a perspective view of an LED lamp according to Embodiment 3.

FIG. 7 is a perspective view of an LED lamp according to Embodiment 3. An LED lamp 60 is attached to a lighting apparatus 1 shown in FIG. 1A. The LED lamp 60 includes a globe 61, an outer case 62, and a base 63, and houses an LED module 200. Furthermore, a driving circuit (not shown in FIG. 7), which includes a variable current source, is provided inside the outer case 62 and the base 63. The variable current source generates variable current according to an AC light adjusting signal provided from a light adjuster to supply the variable current to the LED module 200. With the configuration, the variable current is supplied to the LED module 200 in accordance with the light adjusting operation, and light emitted from the LED lamp 60 is adjusted.

In the LED lamp 60, an upper surface of an approximately ring shaped base platform serves as a mounting board 201 on which a plurality of LEDs 211 and a plurality of LEDs 221 are mounted.

Figure 8A:
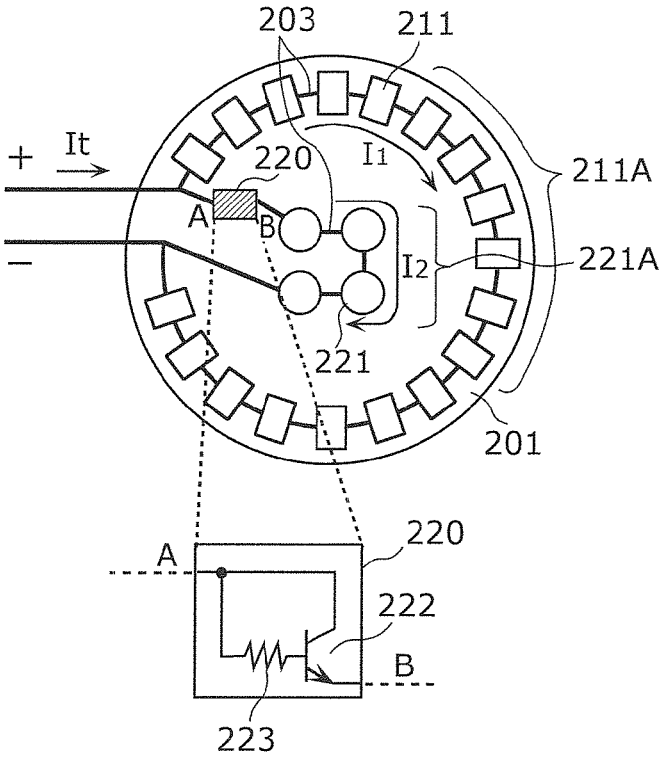
FIG. 8A is a first example of a layout view of components in an LED module according to Embodiment 3.
Figure 8B:
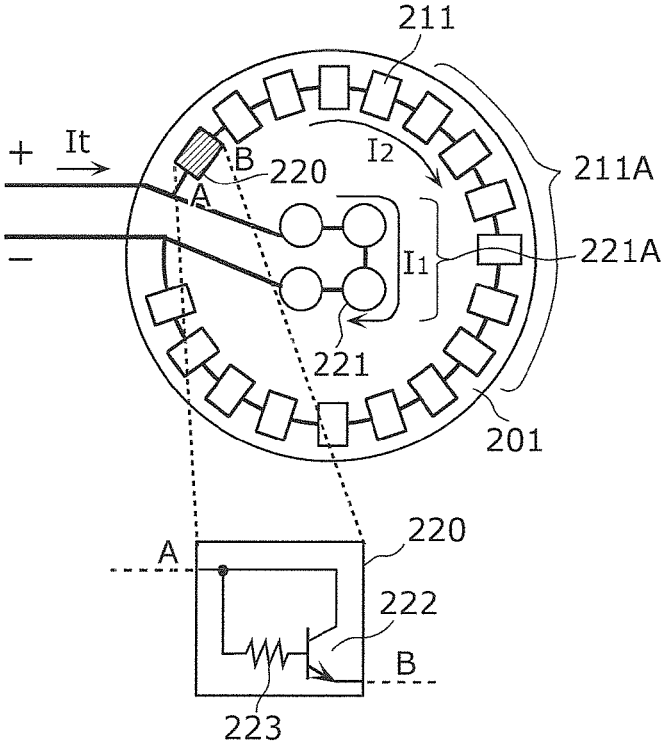
FIG. 8B is a second example of a layout view of components in the LED module according to Embodiment 3.

FIG. 8A is a first example of a layout view of components of the LED module according to Embodiment 3. FIG. 8B is a second example of the layout view of the components of the LED module according to Embodiment 3. The layouts in FIG. 8A and FIG. 8B are different in that a current control element including a transistor 222 and a resistive element 223 is provided at the second branch current I2 side in FIG. 8A and the current control element including the transistor 222 and the resistive element 223 are provided at the first branch current I1 side in FIG. 8B. The layout shown in FIG. 8A is used in the case where first total forward voltage Vt1 is higher than second total forward voltage Vt2. The first total forward voltage is obtained by serial addition of the forward voltages of the LEDs 211 and includes the same number of the forward voltages as the number of the LEDs 211. The second total forward voltage is obtained by serial addition of the forward voltages of the LEDs 221 and includes the same number of the forward voltages as the number of the LEDs 221. On the other hand, in the case where Vt1 is lower than Vt2, the layout shown in FIG. 8B is used.

The LED module 200 is a light-emitting module which includes: the mounting board 201; an LED array 211A; an LED array 221A having light distribution properties different from those of the LED array 211A; and a current control element. As shown in FIG. 8A and FIG. 8B, the LED array 211A includes a plurality of the LEDs 211 connected in series, and is provided, for example, in a ring shape around the outer periphery region of the mounting board 201. On the other hand, the LED array 221A includes a plurality of the LEDs 221 connected in series, and is, for example, provided collectively in the center region of the mounting board 201. More specifically, the LEDs 221 in the LED array 211A and the LEDs 221 in the LED array 221A have different layouts, and the different layouts causes the LED array 211A serving as a first light-emitting unit and the LED array 221A serving as a second light-emitting unit to have different light distribution properties.

Each of the LEDs 211 is, for example, a first light-emitting element which emits white light, and which includes a blue LED chip and a sealing material including a yellow phosphor. Each of the LEDs 221 is, for example, a second light-emitting element which emits white light, and which includes a blue LED chip and a sealing material including a yellow phosphor. The sealing material is formed of, for example, a translucent material, such as silicon resin, and a phosphor. The LED array 211A is the first light-emitting unit through which first branch current I1 of the DC variable current It flows. The LED array 221A is the second light-emitting unit through which second branch current I2 of the DC variable current It flows. In Embodiment 3, the LED array 211A and the LED array 221A have different light distribution properties. In FIG. 8A and FIG. 8B, eighteen LEDs 211 and four LEDs 221 are provided, but the number of LEDs may varies.

The mounting board 201 has a wiring pattern 203 which allows wiring to be connected to the LEDs 211 and the LEDs 221. It may be that the current control element is not provided on the mounting board 201, but provided at the backside of the mounting board.

The layouts of the LED arrays 211A and 221A may be other than the ring shape or being provided collectively in the central region as shown in FIG. 8A and FIG. 8B. The layouts of the LED arrays 211A and 221A may be rectangle or elliptical corresponding to the shape of the LED lamp 60.

Furthermore, the mounting board 201 is not limited to the approximate ring shape, but may have any shape corresponding to the shape of the Led lamp 60. Furthermore, the surface of the mounting board 201 need not be entirely flat as long as the LEDs provided are flat. Furthermore, the backside of the mounting board 201 need not be flat.

The LED module 200 is, for example, screwed to the base platform together with a reflective component 64. The LED module 200 may also be fixed to the base platform through adhesion or engagement.

The reflective component 64 is a substantially circular cylinder having a larger outside diameter at the upper portion than the lower portion. The reflective component 64 is provided above the LED module 200 while not contacting the LED array 211A and in such a manner that the cylindrical axis of the reflective component 64 and the surface of the mounting board 201 are orthogonal to each other.

The reflective component 64 includes a plurality of openings 65 arranged at a distance from each other along the circumferential direction of the outer periphery. More specifically, the same number of openings 65 as the LEDs 211 are equally spaced along the circumferential direction of the outer periphery such that the openings 65 are opposed to the LEDs 211 in one-to-one correspondence.

In Embodiment 3, each opening 65 is a through-hole and has nothing fit inside; however, the opening 65 may have a configuration other than the above as long as light is allowed to exit upward. For example, it may be that a translucent component is fit into the opening 65 entirely or partially allowing light passing through the translucent component to exit forward. Furthermore, the number of the openings 65 may be different from the number of the LEDs 211, and may be less or greater than the number of the LEDs 211, or may be one or plural.

Figure 9:
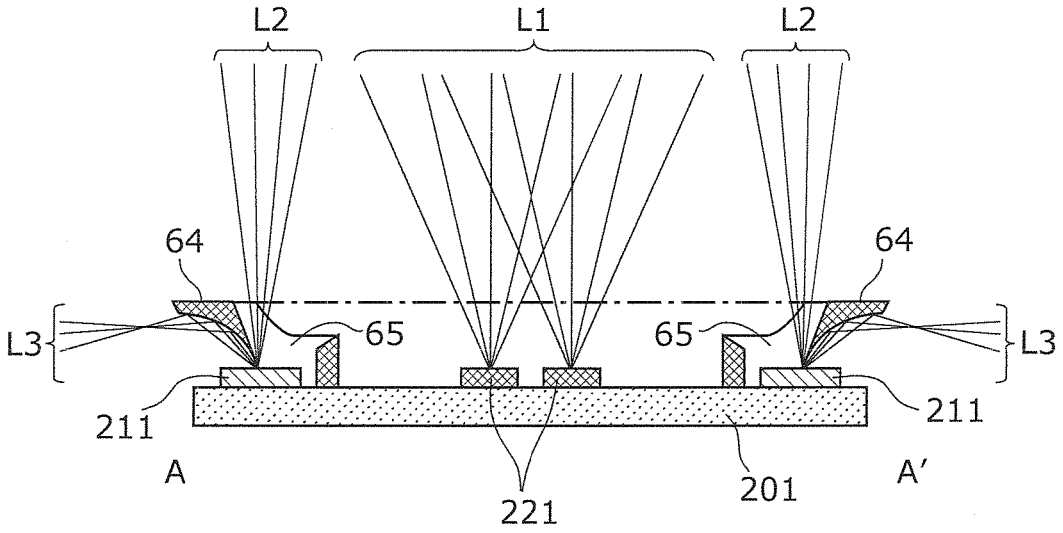
FIG. 9 is a schematic cross-sectional view of optical paths from the LED module according to Embodiment 3.

FIG. 9 is a schematic cross-sectional view of optical paths from the LED module according to Embodiment 3. As shown in FIG. 9, light emitted from the LEDs 221 travel along the light paths L1 in an upward direction. On the other hand, light emitted from the LEDs 211 has a component which passes through the opening 65 and travels along the light paths L2 in an upward direction and a component which is reflected by the outer peripheral surface of the reflective component 64 and travels along the optical paths L3 to the side laterally. More specifically, light emitted from the LEDs 211 is diffused into the upper and lateral directions by the reflective component 64. Hence, the LED array 221A and the LED array 211A have different light distribution angles.

[Configuration of Light-Emitting Circuit]

The circuit configuration of the LED module 200 in the LED lamp 60 having such a configuration is the substantially same as that of the circuit shown in FIG. 2 according to Embodiment 1. The circuit configuration of the current control element 220 is also the substantially same as that shown in FIG. 2. The transistor 222 corresponds to the transistor 122 in FIG. 2, and the resistive element 223 corresponds to the resistive element 123 in FIG. 2.

Of the layouts shown in FIG. 8A and FIG. 8B, a description is given of the layout shown in FIG. 8A.

According to the operation of the transistor 222, the differential voltage Vd determined by the configuration of the LED array 211A and the LED array 221A is almost constant in a predetermined current range. Accordingly, the base current Ib and the collector current Ic are maintained almost constant, which makes the second branch current I2 almost constant in the predetermined current range even if the DC variable current It changes. Hence, the change in the DC variable current It almost equals to the change in the first branch current I1. More specifically, in a predetermined light adjusting range, the change rate of the second branch current I2 relative to the change in the light adjusting level is lower than the change rate of the DC variable current It relative to the change in the light adjusting level. Due to the difference between (i) the change in the first branch current I1 relative to the change in the DC variable current It and (ii) the change in the second branch current I2 relative to the change in the DC variable current It, the ratio of the first branch current I1 and the second branch current I2 changes in response to the change in the DC variable current It. More specifically, it is possible to change the light distribution properties of the LED module 200 in accordance with the light adjusting operation, by changing, according to the light adjusting level, the ratio of current flowing through the two types of LED arrays 211A and 221A having different light distribution properties.

Furthermore, the circuit components required for the above light-emitting circuit are, other than the LEDs serving as the light-emitting elements, only the transistor 222 and the resistive element 223. As a result, it is possible to change the light distribution properties according to the light adjusting level, with reduced numbers of the circuit elements, such as signal lines or a variable voltage circuit for changing the base-collector voltage or the base-emitter voltage of the transistor 222.

[Characteristics of Light-Emitting Module]

Figure 10A:
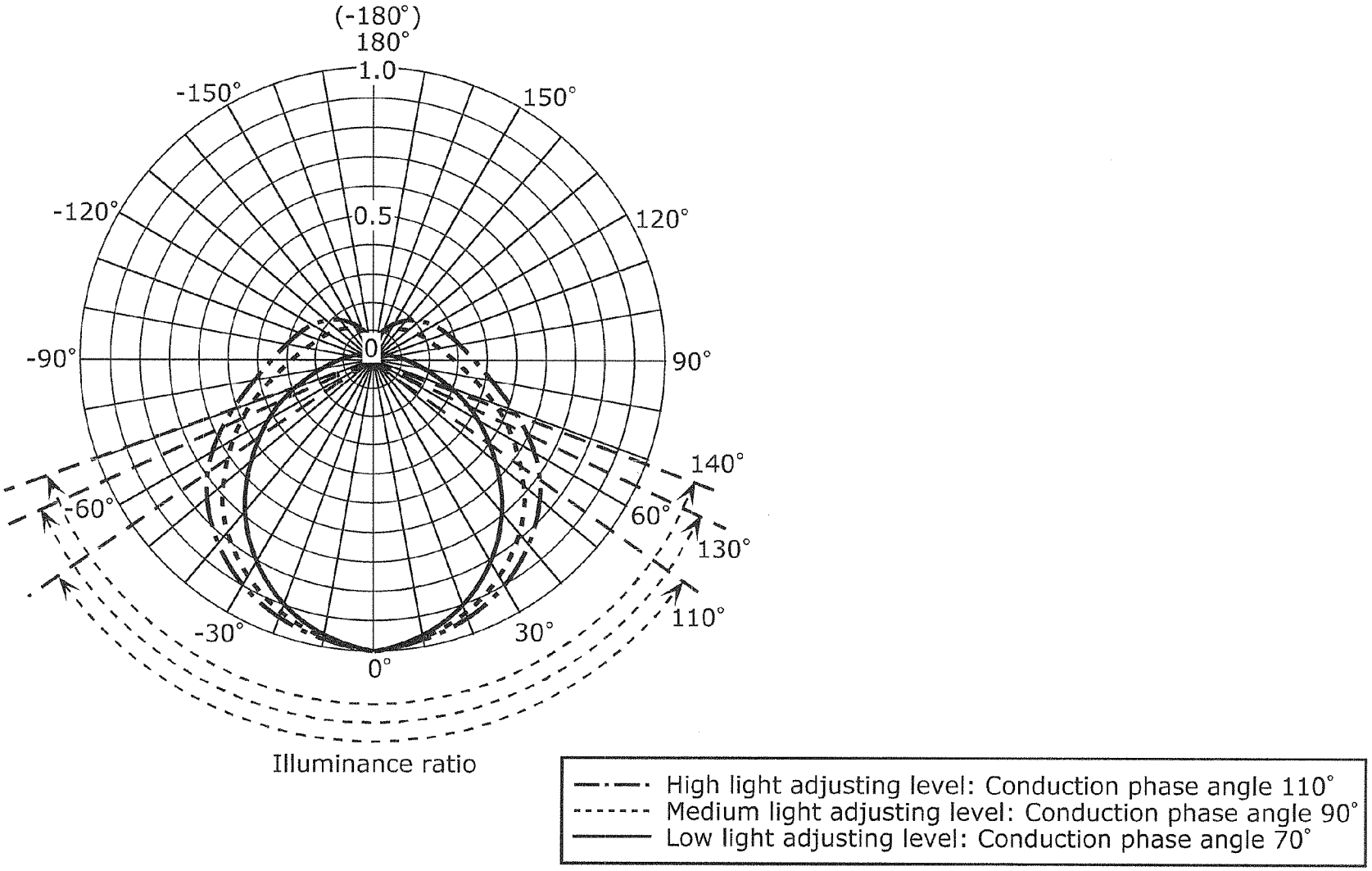
FIG. 10A is a light distribution curve diagram represented by illuminance ratio of the LED lamp according to Embodiment 3.
Figure 10B:
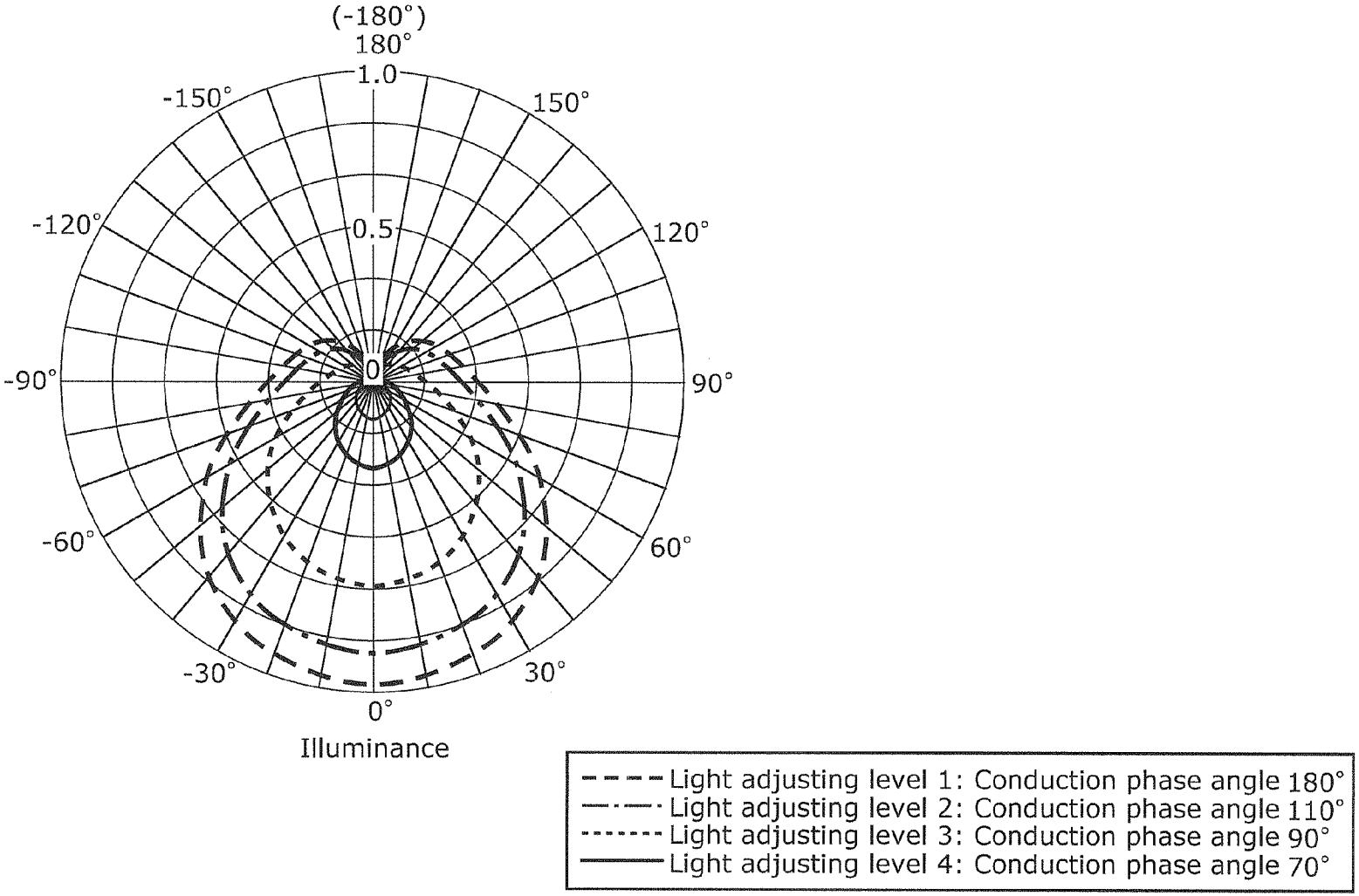
FIG. 10B is a light distribution curve diagram represented by illuminance of the LED lamp according to Embodiment 3.
Figure 11:
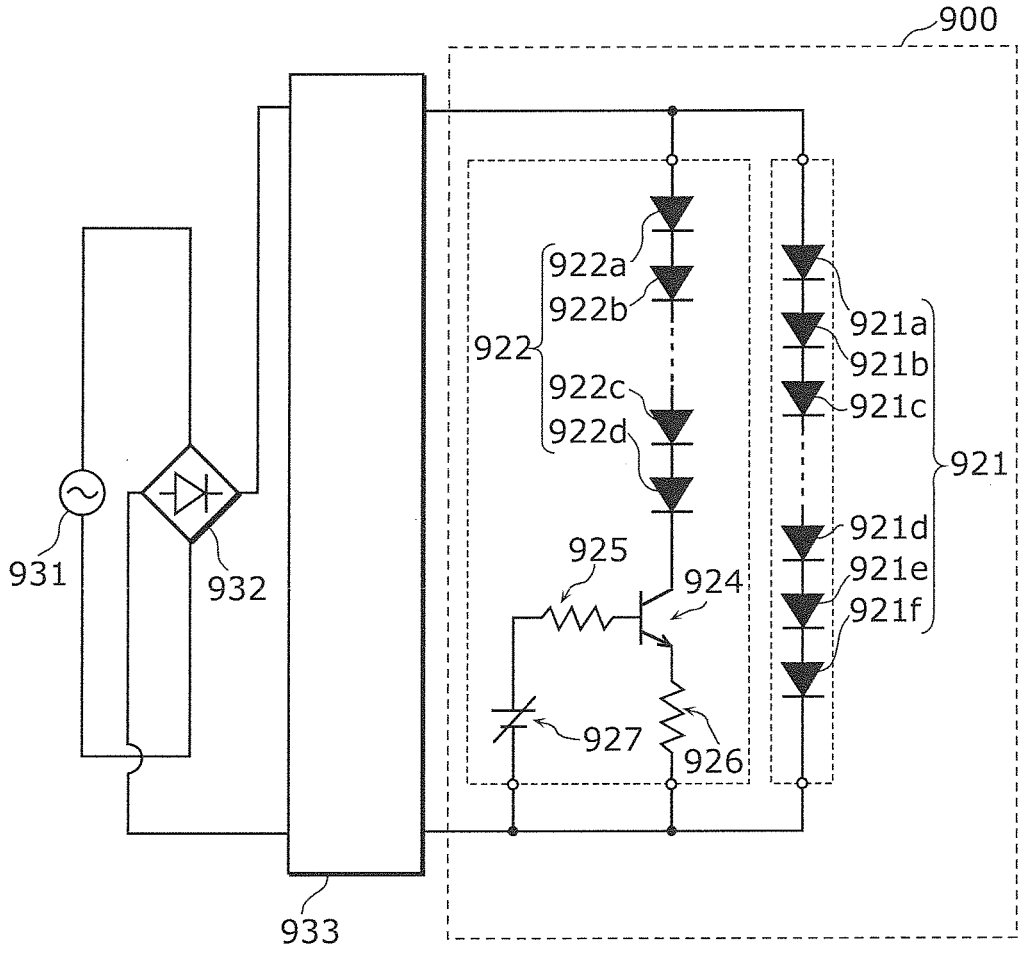
FIG. 11 Prior art
FIG. 11 is a circuit diagram of a conventional LED module disclosed in PTL 1.

Next, referring to FIG. 10A and FIG. 10B, a description is given of light distribution properties of the LED module 200 according to Embodiment 3.

FIG. 10A is a light distribution curve diagram represented by illuminance ratio of the LED lamp according to Embodiment 3, while FIG. 10B is a light distribution curve diagram represented by illuminance of the LED lamp according to Embodiment 3. The light distribution curve diagram in FIG. 10A represents illuminance level relative to respective directions of 360 degrees (including up and down directions) of the LED lamp 60. With 0 degrees representing the up direction along the lamp axis of the LED lamp 60, and 180 degrees (−180 degrees) representing the down direction along the lamp axis, scale is given every ten degrees in the clockwise and counterclockwise directions. The scale (0.1 to 1.0) given in a radial direction of the light distribution curve diagram denotes illuminance ratio which is represented relatively with the maximum value in the light distribution curve of 1.0 (100%). In this way, FIG. 10A shows the illuminance ratio in the range from −180 degrees to +180 degrees, relative to the lamp axis of the LED lamp 60.

Here, the LED module 200 having the light distribution properties shown in FIG. 10A and FIG. 10B includes the LED array 211A including eight LEDs 211 connected in series. Each LED 211 has forward voltage Vt1 of approximately 3 V and a warm white phosphor (color temperature of 2800 K). Furthermore, the LED module 200 includes the LED array 221A including four LEDs 221 connected in series. Each LED 221 has forward voltage Vt2 of approximately 3 V, and a warm color phosphor (color temperature of 2800 K). Such a configuration results in the first total forward voltage of 24 V (Vt1×the number of LEDs 211) and the second total forward voltage of 12 V (Vt2×the number of LEDs 221). As a result, the differential voltage Vd is 12 V. The LED array 211A is arranged in a ring-shape around the outer periphery region of the mounting board 201. The LED array 211A has light distribution properties in which light is emitted not only in the upward direction, but also in the lateral direction due to the reflective component 64. On the other hand, the LED array 221A is provided collectively in the central region of the mounting board 201, and has light distribution properties in which light is emitted in the upward direction without being influenced by the reflective component 64. More specifically, the LEDs 211 in the LED array 211A and the LEDs 221 in the LED array 221A have different layouts, and the different layouts causes the different light distribution properties between the LED array 211A serving as the first light-emitting unit and the LED array 221A serving as the second light-emitting unit. Furthermore, the resistive element 223 has a resistance value of 100 kΩ.

In FIG. 10A, the light distribution properties are evaluated based on the light distribution angle. The light distribution angle refers to the size of the angular range in which illuminance greater than or equal to half the maximum value of illuminance of the LED lamp is emitted. For example, in the case of the light distribution curve shown in FIG. 10A, the light distribution angle is the size of the angular range in which illuminance ratio is at least 0.5 (50%). As shown in FIG. 10A, the light distribution angle of the LED lamp 60 is approximately 110 degrees at low light adjusting level (conduction phase angle of 70 degrees), the light distribution angle of the LED lamp 60 is approximately 130 degrees at middle light adjusting level (conduction phase angle of 90 degrees), and the light distribution angle of the LED lamp 60 is approximately 140 degrees at high light adjusting level (conduction phase angle of 110 degrees). More specifically, as the light adjusting level increases, the ratio of the first branch current I1 relative to the DC variable current It increases, resulting in an increase in the light distribution angle.

The scale (0.1 to 1.0) given in the radial direction of the light distribution curve in FIG. 10B denotes illuminance ratio when the maximum output of the light adjuster is 1. As shown in FIG. 10B, as the light adjusting level increases, both the light distribution angle and illuminance increase. More specifically, setting luminance higher leads to an increase in the light distribution angle.

In the above light distribution properties, the rate of increase in the second branch current I2 relative to an increase in the DC variable current It is lower than the rate of increase in the first branch current I1 relative to the increase in the DC variable current It. This is due to the following reason: As mentioned in the description of the circuit configuration of the LED module, the differential voltage Vd keeps the base current Ib and the collector current Ic to almost constant values. Hence, a change in the DC variable current It in a predetermined current range causes a small change (almost no change) in the second brunch current I2. The change in the second branch current I2 relative to the change in the DC variable current It is small, whereas the change in the first branch current I1 is almost equal to the change in the DC variable current It. More specifically, the graphs in FIG. 10A and FIG. 10B show that an increase in the current ratio of the first branch current I1 with an increase in the DC variable current It causes the light distribution angle to be changed with an increase in luminance. With the configuration example of the LED according to Embodiment 3, the LED lamp 60 has light distribution properties in which the light distribution angle increases by setting luminance higher through the light adjusting operation and the light distribution angle decreases by setting luminance lower through the light adjusting operation.

As described above, in the LED module 200 according to Embodiment 3, appropriate selections are made on the light distribution properties and the number of serial connections of the LEDs in the LED arrays 211A and 221A, and the resistance value of the resistive element connected to the base terminal of the transistor. Such a selection leads to an intended change in light distribution properties according to a change in light adjusting level, with reduced numbers of circuit components other than the LEDs. More specifically, by providing a plurality of LED arrays having different total forward voltages, it is possible to exhibit a rendered lighting effect, such as a change in light distribution properties according to light adjustment, with reduced numbers of circuit components.

Descriptions have been given of the light-emitting circuit, the light-emitting module, and the lighting apparatus according to the present invention, based on Embodiment 1 to Embodiment 3; however, the present invention is not limited to the embodiments. The herein disclosed subject matter is to be considered descriptive and illustrative only, and the appended Claims are of a scope intended to cover and encompass not only the particular embodiments disclosed, but also equivalent structures, methods, and/or uses.

For example, the LED module 200 according to Embodiment 3 may include the current control element 220 formed of only the resistive element as in Embodiment 2.

Furthermore, for example, in Embodiments 1 to 3, each LED array includes a plurality of LEDs connected in series, but the LED array may include one LED. In such a case, however, each LED has different forward voltage. Furthermore, it is preferable that the difference between the forward voltages is at least 0.7 V, so that change in emission color caused according to change in luminance of the LED module is significantly recognized.

In Embodiments 1 to 3, it is assumed that the DC variable current It has two branch current paths; however, the DC variable current It may have three or more branch current paths. More specifically, each branch current path has an LED array having a different emission color or a different light distribution property and a different total forward voltage, and a current control element is provided in each of the current paths other than the current path having the LED array with the largest total forward voltage. The present invention includes an LED module with such a configuration, and produces the similar advantageous effects.

In the above embodiments, an LED which emits red light includes a blue LED chip and a sealing material including a red phosphor and a green phosphor, but the present invention is not limited to the example. For example, the LED which emits red light may include only a red LED chip.

Furthermore, the light adjuster 160 may change the conduction phase angle according to the light adjusting level instructed by a user, or change the conduction phase angle according to the amount of light received by a light sensor.

In the above embodiments, the LED module is applied to the bulb-shaped lamp; however, may also be applied to, for example, ceiling light and halogen lamp.

Furthermore, in the above embodiments, descriptions have been given of examples where the lighting apparatus 1 includes the LED lamp 10 or 60 and the light adjuster 160; however, it is sufficient that the lighting apparatus 1 includes a driving circuit, the LED module 100, and the light adjuster 160, and need not include a case such as a globe or an outer case.

The lighting apparatus 1 includes one LED lamp 10 or 60, but may include, for example, two or more LED lamps 10 or 60.

The circuit configurations in the above circuit diagrams are shown as examples. The present invention is not limited to the examples. More specifically, the present invention also includes a circuit which achieves the characteristic functions of the present invention in the similar manner to the above circuit configurations. For example, the present invention includes a circuit in which an element is connected to another element such as a transistor, a resistive element, or a capacitive element in series or in parallel, in a range which allows the functions similar to those of the above circuit configurations. In other words, the expression "is (are) connected" in the above embodiments is not limited to the case where two terminals (nodes) are directly connected, but also includes the case where the two terminals (nodes) are connected via an element in a range which allows the similar functions.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

The invention claimed is:

1. A light-emitting circuit which emits light in response to a variable current, the light being emitted according to the variable current, the light-emitting circuit comprising:

a first light-emitting unit which includes one or more first light-emitting elements connected in series, and through which a first branch current of the variable current flows;

a second light-emitting unit which includes one or more second light-emitting elements connected in series, and through which a second branch current flows, the second branch current being a differential current between the variable current and the first branch current; and a current control element which is connected to the second light-emitting unit in series, and which adjusts the second branch current according to a differential voltage between a first total forward voltage and a second total forward voltage, the first total forward voltage being a sum of a forward voltage generated by each of the one or more first light-emitting elements, the first total forward voltage including the same number of the forward voltages as the number of the one or more first light-emitting elements, the second total forward voltage being a sum of a forward voltage generated by each of the one or more second light-emitting elements, the second total forward voltage including the same number of the forward voltages as the number of the one or more second light-emitting elements.

2. The light-emitting circuit according to claim 1, wherein the one or more first light-emitting elements emit light of a first color, and the one or more second light-emitting elements emit light of a second color different from the first color.

3. The light-emitting circuit according to claim 1, wherein the first light-emitting unit and the second light-emitting unit have different light distribution properties.

4. The light-emitting circuit according to claim 3, wherein the one or more first light-emitting elements and the one or more second light-emitting elements have different layouts, and the different layouts cause the different light distribution properties.

5. The light-emitting circuit according to claim 1, wherein the current control element has a first terminal, a second terminal, and a control terminal, the first terminal and the second terminal are provided on a path of the second branch current, and the current control element adjusts the second branch current corresponding to the differential voltage generated between the first terminal and the second terminal, in response to a control signal provided to the control terminal.

6. The light-emitting circuit according to claim 5, wherein the current control element is an NPN bipolar transistor, the control terminal is a base terminal, the first terminal is a collector terminal, and the second terminal is an emitter terminal, and the first terminal is provided closer to a higher potential side of the path of the second branch current than the second terminal is, and the control terminal and the first terminal are connected via a resistive element.

7. The light-emitting circuit according to claim 5, wherein the current control element is a PNP bipolar transistor, the control terminal is a base terminal, the first terminal is an emitter terminal, and the second terminal is a collector terminal, the first terminal is provided closer to a higher potential side of the path of the second branch current than the second terminal is, and the control terminal and the second terminal are connected via a resistive element.

8. The light-emitting circuit according to claim 5, wherein the first light-emitting unit has a first anode terminal at an anode side and a first cathode terminal at a cathode side, the second light-emitting unit has a second anode terminal at an anode side and a second cathode terminal at a cathode side, the first terminal and the first anode terminal are connected to a higher potential terminal of a variable current source which supplies the variable current, the second terminal and the second anode terminal are connected to each other, and the first cathode terminal and the second cathode terminal are connected to a lower potential terminal of the variable current source.

9. The light-emitting circuit according to claim 1, wherein the current control element is a resistive element.

10. The light-emitting circuit according to claim 9, wherein the first light-emitting unit has a first anode terminal at an anode side and a first cathode terminal at a cathode side, the second light-emitting unit has a second anode terminal at an anode side and a second cathode terminal at a cathode side, the first anode terminal and a first terminal of the resistive element are connected to a higher potential terminal of a variable current source which supplies the variable current, the second anode terminal and a second terminal of the resistive element are connected to each other, and the first cathode terminal and the second cathode terminal are connected to a lower potential terminal of the variable current source.

11. The light-emitting circuit according to claim 1, wherein a change rate of the second branch current relative to a change in the variable current is lower than a change rate of the first branch current relative to the change in the variable current.

12. The light-emitting circuit according to claim 2, wherein the first color is white, and the second color is red.

13. A light-emitting module comprising:

a mounting board, and the light-emitting circuit according to claim 1, the light-emitting circuit being located on the mounting board.

14. A lighting apparatus comprising:

a light adjuster which generates, by using an alternating-current (AC) source, an AC light adjusting signal which represents a level of light adjustment;

a variable current source which generates the variable current according to the AC light adjusting signal; and the light-emitting module according to claim 13, the light-emitting module receiving the variable current from the variable current source.

* * * * *